United States Patent [19]

Carn

[11] Patent Number: 4,815,407

[45] Date of Patent: Mar. 28, 1989

[54] RIGGING, IN PARTICULAR FOR A SAIL BOARD

[76] Inventor: Patrick Carn, FR-29125 Radennec en Loctudy, France

[21] Appl. No.: 11,920

[22] Filed: Feb. 6, 1987

Related U.S. Application Data

[63] Continuation of Ser. No. 708,635, Mar. 6, 1985, abandoned.

[30] Foreign Application Priority Data

Jul. 6, 1983 [FR] France ..... 83 11223
Jun. 4, 1984 [FR] France ..... 84 08704

[51] Int. Cl.[4] ..... B63H 9/08

[52] U.S. Cl. ..... 114/91; 114/39.2; 114/90; 114/97; 114/98; 114/102; 114/103; 114/109

[58] Field of Search ..... 114/90–98, 114/102–104, 108, 109, 111, 39.2

[56] References Cited

U.S. PATENT DOCUMENTS 2,065,715 12/1936 Leon ..... 114/90
3,147,729 9/1964 Barnard ..... 114/108
4,382,417 5/1983 Talve ..... 114/39.2
4,530,299 7/1985 Ross ..... 114/90

FOREIGN PATENT DOCUMENTS 2544690 10/1984 France ..... 114/39

*Primary Examiner*—Joseph F. Peters, Jr.
*Assistant Examiner*—Clifford T. Bartz
*Attorney, Agent, or Firm*—Steele, Gould & Fried

[57] ABSTRACT

Rigging for nautical or terrestrial craft comprising a sail (1) integral with a mast hinged to the craft. According to the invention, the sail (1) is stretched onto symmetrical uprights (2) which are themselves bent by a cable (7) tensioned by a hoist (10) so as to give the sail a lenticular shape.

10 Claims, 2 Drawing Sheets

RIGGING, IN PARTICULAR FOR A SAIL BOARD

This is a continuation of application Ser. No. 708,635, filed Mar. 6, 1985, now abandoned.

BACKGROUND OF THE INVENTION

1. Field of the Invention

The present invention relates to rigging, particularly but not exclusively, for sail boards and in particular for boards known as "fun-boards".

2. Description of the Prior Art

It is known that the rigging of sail boards is presently provided by means of a triangular sail threaded over a mast which is itself fixed to the board per se by means of a hinge. The sail is maneuvered by means of a two-part boom or "wishbone". Such rigging is described in U.S. Pat. No. 3,487,800 in the name of Schweitzer.

This widely-used rigging is satisfactory for conventional sail boards even though its drive is not perfect, in particular because the wind causes the mast to bend and thus causes the sail to spill air and lose drive.

So-called "fun-boards" have recently appeared which are smaller than conventional sail boards and which do not support the user until the board is moving, thus requiring starts of the water skiing type with the user in the water. With this type of board, the above-mentioned type of rigging makes changing tack with the wind astern difficult since at the moment of jibing the sail is edge-on to the wind: at this moment the user is likely to end up in the water unless the board has sufficient way to allow the change of tack to be completed.

SUMMARY OF THE INVENTION

The object of the present invention is to remedy this drawback by proposing rigging having improved drive over the known prior technique.

According to the present invention, the rigging mounted on a hinged mast footing is characterized in that it comprises a symmetrical sail set up on a frame constituted by two vertical risers which are connected at their top and bottom portions, the height of the sail being greater than its width.

European published patent application No. 0031074 (Schliebs) describes rigging for a sail board mounted on a hinged mast footing and comprising a closed frame which is longitudinally symmetrical and on which the sail is set, together with a transverse maneuvering spar which bears across the frame. The top part of the frame is bowed in its plane while the bottom part rests on the mast footing and is L-shaped.

The frame is rigid and undeformable. The presence of the L-shape in the bottom branches prevents deformation of the frame. Given that it is not stiffened in the longitudinal direction, the frame risers have to be thick and are consequently heavy and not aerodynamic, thereby leading to poor drive from the rigging.

The aim of the present invention is to remedy the drawbacks of known rigging and to propose rigging having improved drive in comparison with that of the prior art.

According to the present invention, the rigging for a water or land vessel comprises a sail set on a closed frame having longitudinal symmetry with its bottom portion resting on a hinged mast footing, and a transverse bar fixed across the frame, the rigging being characterized in that the frame is constituted by two risers which are interconnected at their top and bottom portions and which are bowed in such a manner as to give the sail a lens shape.

According to another characteristic of the invention, the above-mentioned frame is bowed by means of at least one cable which is taut between the top and the bottom of the rigging.

The risers are bowed in their plane and in a plane perpendicular to their rest position so as to give the sail a lens shape, and a maneuvering spar or boom has its concave side facing the concave side of the inflated sail. The rigging in accordance with the invention provides a lens-shaped sail subtended from bow-shaped members with touching tips. It is known that such a structure is extremely strong and rigging made in this way is rigid enough to take best advantage of the available wind energy. Preferably, the maneuvering spar is disposed substantially one-third of the way up and in between the vertical risers.

According to yet another characteristic of the invention, each of the risers constituting the mast is provided, at boom height, with a hinge. In the event of difficulty, the rigging may fold and thus avoid breaking.

Other characteristics and advantages of the invention appear from the following description made with reference to the accompanying drawings and relating to various embodiments of the invention. In the drawings:

DESCRIPTION OF THE PREFERRED EMBODIMENT

Figure 1:
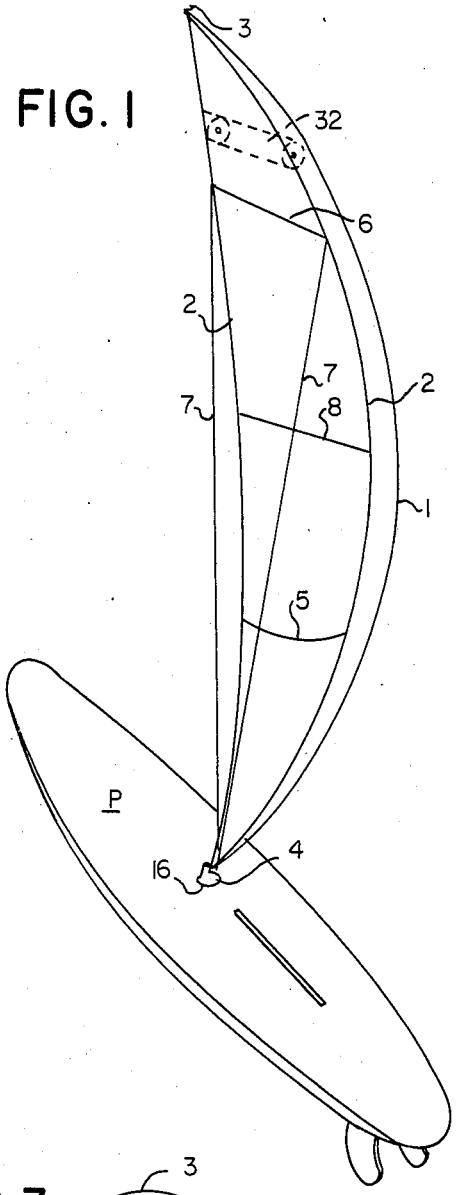
FIG. 1 is a perspective view of the first rigging in accordance with the invention.
Figure 2:
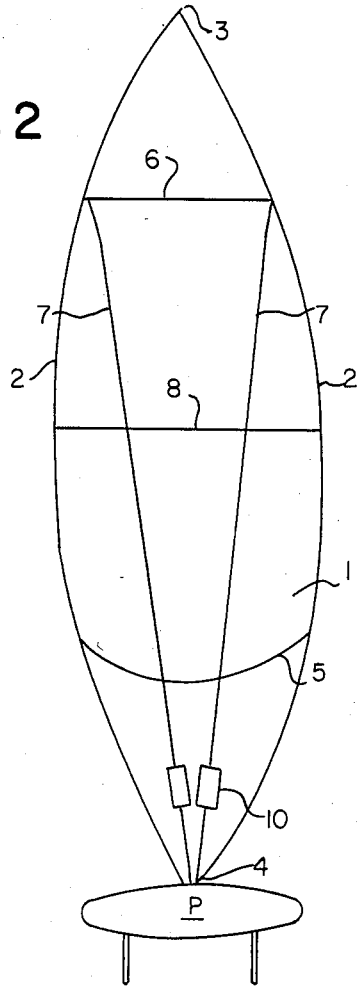
FIG. 2 is a rear view of the same rigging.

In FIGS. 1 and 2, the sail 1 is suspended from risers 2 which are interconnected at their top and bottom ends 3 and 4. The bottom end 4 bears against a board P via a hinge 16. The hinged mast footing 16 enables the rigging to move into any desired position above the horizontal plane. It is known that the drive from a sail close to the surface of the water is poor because of the irregularity of air currents at this level. A degree of consistency in direction is only to be found slightly further up, and in accordance with a characteristic of the invention, the sail is rather vertical with the ratio of its height divided by its width being greater than that for an ordinary sail. Thus, the role of irregular air currents at the surface is reduced to a minimum in propelling the board. The risers 2 are tensioned by means of one or more cables 7 having tightening means 10 (FIG. 2) e.g. of the pulley-block type running between the mast footing 16 and a horizontal spar 6 disposed near the top portion of the sail. This tension is applied to the risers (2) prior to the rigging being fitted to the board. Depending on the need, one or two cables 8 or spars 6 prevent excessive deformation of the sail under the influence of the traction exerted by the cables 7. At man height, the rigging is held in the user's hand by means of a horizontal spar 5 which is preferably curved in the opposite direction to the direction in which the sail is curved. This rigging is used in the same manner as conventional rigging for moving in various directions, but jibing is made easier since the sail is symmetrical so the user causes it to pass perpendicularly to the wind direction ahead of the user rather than causing it to pass through the eye of the wind, and thereby swaps the leading and trailing edges on the other tack. There is thus no loss of power during jibing since the sail is never in the plane of the wind. Further, the concave shape of the sail increases its power and its undeformability by means of the vertical cables which constrain the tubes to act as strung bows counterbalancing the traction of the user on the boom. The risers 2 may be made of light alloy based on aluminum or on fiber glass or on carbon fiber embedded in a suitable resin.

Figure 3:
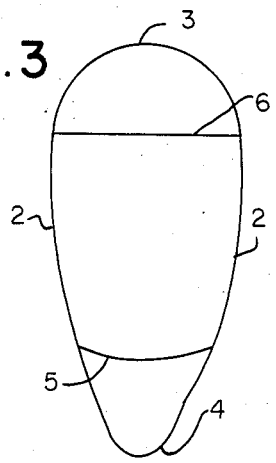
FIG. 3 is a rear view of a sail of different shape.

In FIGS. 1 and 2, the sail is lens-shaped. A cable 8 may be mounted between the risers 2 in such a manner as to prevent them from moving too far apart in the vertical plane and thus spoiling the bowing. It is also possible to use a frame such as shown in FIG. 3 in which the top portion has a greater sail area than the bottom portion with the risers 2 being interconnected at the top 3 and at the bottom 4.

Figure 4:
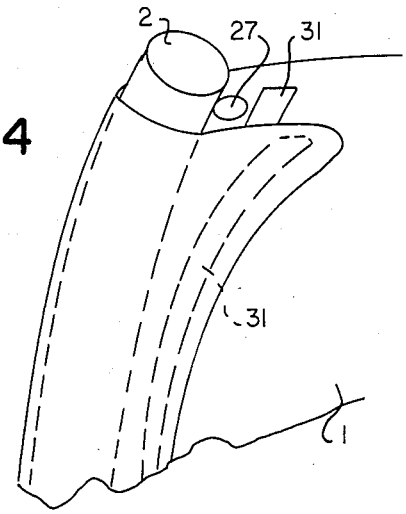
FIG. 4 shows a particular way of mounting the sail on the vertical risers of the frame.

FIG. 4 shows how the sail 1 is mounted on a riser 2 by means of a sheath fitted with closure means 31 which may be of the Velcro (trademark) type or which may be a buttoning or zipfastening system. Eye-rings 27 fitted at various points along the riser 2 enable the sail to be drawn towards the end of the tube by means of cordage (not shown). This system of sail mounting, together with the geometrical structure of the sail, make it very easy to reduce said area by taking in sail. All that needs to be done is to remove the top portion of the sail from the risers 2 and to roll it down as far as desired as shown diagrammatically at 32 in FIG. 1.

Figure 5:
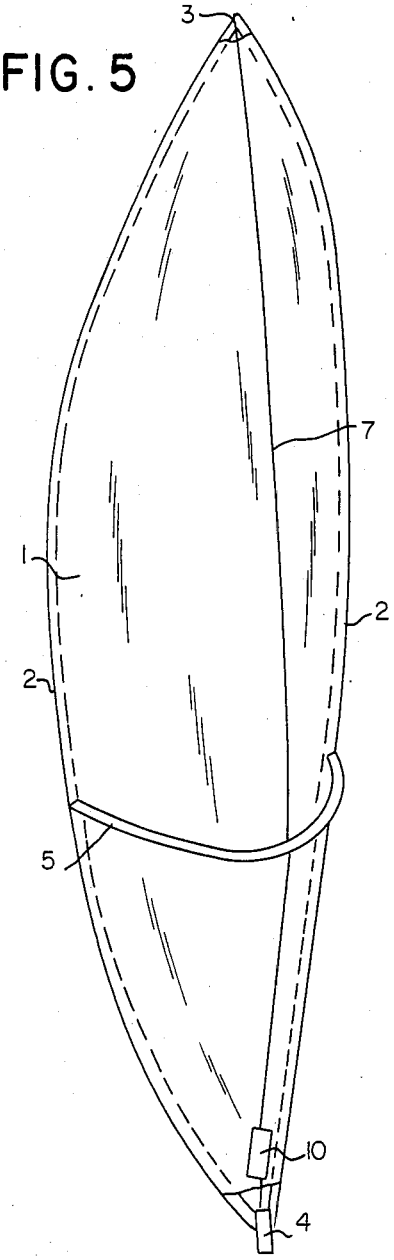
FIG. 5 shows a variant way of mounting the rigging.

In FIG. 5, the rigging is constituted by a sail 1 mounted on two symmetrical risers which are interconnected at top 3 and bottom 4. The risers 2 are pre-tensioned like strung bows by means of a cable 7 which is tightened by a pulley-block 10. Substantially one-third of the way up the sail, a rounded spar 5 serves to maneuver the rigging, and the cable 7 is not connected to the spar 5. The cable 7 passes outside the spar 5 so that the inclination of the spar serves to adjust the cable tension and consequently the hollow of the sail. The boom 5 is fixed to the risers 2 by cordage.

Figure 6:
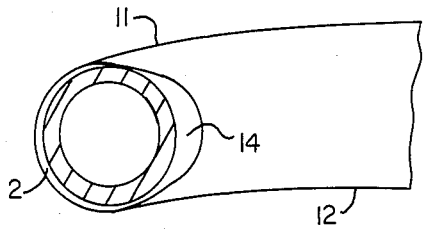
FIG. 6 is a horizontal section through a thick sail.
Figure 7:
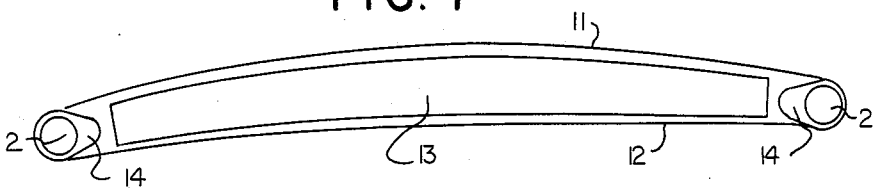
FIG. 7 is a diagram showing how a thick sail is mounted on a riser.

As mentioned above, the symmetrical shape of the rigging makes it possible to use a full or thick sail. As can be seen in FIG. 6, in the symmetrical type of rigging under consideration, it is always the same face 11 of the sail which is convex, i.e. unlike a conventional single sheet sail, the functions of the faces of the sail do not change in use. This rigging is thus particularly suitable for receiving a second sheet of cloth 12 intended to constitute the concave surface and to give it a shape which, in use, is different from the shape of the convex surface 11. Further, the small thickness of the leading edge constituted by one or other of the risers 2 relative to the thickness of conventional masts which have to be fairly thick in order to withstand the forces applied thereto by the sail, is favorable to air-stream lines hugging both faces 11 and 12 of such the sail which consequently behaves rather like an aircraft wing with little drag from the trailing edge. A sail in accordance with another characteristic of the invention comprises two sheets 11 and 12 of cloth which are connected at their ends by two sheaths 14 in which the risers 2 are contained, as can be seen on a larger scale in FIG. 7.

When such a sail is in the wind, the concave sheet 12 is subjected to the wind over pressure and takes up a relatively shallow curve while the convex face 11 is subjected to under pressure which is greater than the over pressure and it therefore takes up a more marked curve following the air streams lines over the face 11. In order to improve the profile of the sail, it is possible to insert a filling 13 between the sheets 11 and 12 which may be a layer of plastic foam or a set of stiffeners or generally any rigid or semirigid material suitable for keeping the two sheets apart. The sheets may, for example, be sewn in such a way that the tensions on each sheet do not tend to equalize, thus preventing interactions between the sheets.

Figure 8:
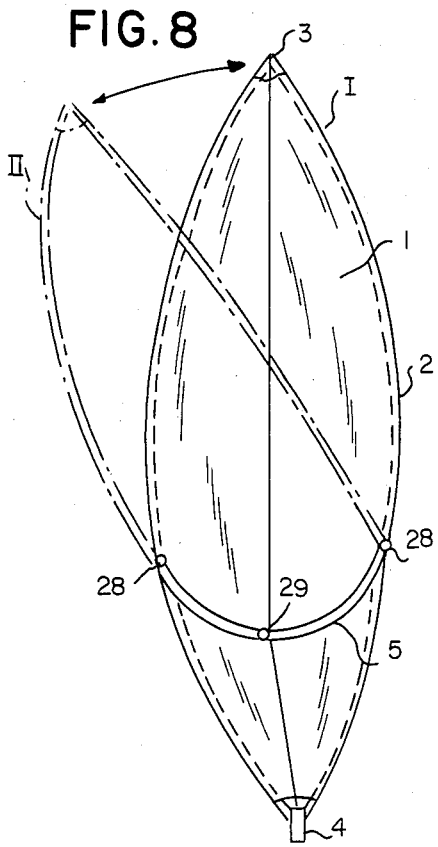
FIG. 8 is a diagram showing hinged risers.

Since the pre-tensioned rigging in accordance with the invention is not very deformable, it is subjected to considerable forces while it lies in breaking waves when the user has let go, after falling into the water. In order to reduce the risks of breaking the risers 2, it is possible as shown in FIG. 8 to provide a hinge 28 at about the level of the spar 5. Thus, the cable 7 withstands forces from behind going forwards while the hinge folds for forces acting in the opposite direction. The hinge 28 provided on each of the risers is naturally locked by a suitably rated keeper acting as a brake. As can be seen in FIG. 8, the rigging can fold from a position I to a position II about the hinges 28 when the forces exerted on the rigging are excessive and exceed the rated force of the brake. When the brake is released, the hinge may be freely folded inwardly thus enabling the overall length of the rigging to be reduced to the height of its upper branch, i.e. to about two-thirds of the total sail height. Preferably, the spar 5 is also fitted with a hinge 29 so as to enable the rigging to be completely folded.

The present invention may be implemented on any occasion that wind force is to be used, and in particular with sailing dingies, sail boards, sail-driven land carts or "Speed-Sails" (registered trademark), and with windskates.

I claim:

1. Rigging for a vessel, the rigging comprising:

a mast footing affixed to the vessel;

a closed frame having a bottom portion supported on the mast footing;

a sail secured on the closed frame and having a longitudinal axis of symmetry;

the frame constituting two risers connected at their top and bottom portions, and a spar interconnecting the risers intermediate the top and bottom portions; and, at least one cable connecting the top portions of the risers to the mast footing under tension, the risers being thereby bowed by the at least one cable to give the rigging an ellipsoid shape when viewed from the front and bowed shape when viewed from the side to define a rigging having an external convex face and an internal convex face, the sail being lens-shaped in configuration.

2. Rigging according to claim 1, wherein the spar defines a boom having opposite ends secured respectively to each riser and disposed substantially one-third of the way up the sail, the boom being curved to define a concave side facing that side of the sail which is concave when the frame is under tension.

3. Rigging according to claim 2, wherein the at least one cable passes the boom on that side of the boom opposite the sail.

4. Rigging according to claim 1, wherein the sail comprises two sheets, a convex sheet and a concave sheet, the sheets having lateral ends comprising sheaths for receiving the risers therein.

5. Rigging according to claim 2, wherein the risers are fitted with hinges near the boom, the hinges enabling the rigging to fold; and, the boom is fitted with a hinge intermediate the opposite ends thereof.

6. Rigging for a vessel, the rigging comprising:

a mast footing affixed to the vessel;

a closed frame having a bottom portion supported on the mast footing;

a sail secured on the closed frame and having a longitudinal axis of symmetry;

the frame constituting two risers connected at their top and bottom portions, and a spar having opposite ends interconnecting the risers intermediate the top and bottom portions;

a cable connecting each end of the spar to the mast footing; and, means for tensioning the cables, the risers being bowed by the cables to give to the rigging on ellipsoid shape when viewed from the front and a bowed shape when viewed from the side to define a rigging having an external convex face and an internal concave face, the sail being lens-shaped in configuration.

7. Rigging according to claim 6, wherein the spar defines a boom disposed substantially one-third of the way up the sail, the boom being curved to define a concave side facing that side of the sail which is concave when the frame under tension.

8. Rigging according to claim 7, wherein the cables pass the boom on that side of the boom opposite the sail.

9. Rigging according to claim 6, wherein the sail comprises two sheets, a convex sheet and a concave sheet, the sheets having lateral ends comprising sheaths for receiving the risers therein.

10. Rigging according to claim 6, wherein the risers are fitted with hinges near the boom, the hinges enabling the rigging to fold; and, the boom is fitted with a hinge intermediate the opposite ends thereof.

* * * * *